US007824161B2

(12) United States Patent
Tandon

(10) Patent No.: US 7,824,161 B2
(45) Date of Patent: Nov. 2, 2010

(54) PUMP SECONDARY SEAL

(75) Inventor: Pradeep Kumar Tandon, Bella Vista (AU)

(73) Assignee: Waterco Limited, Rydalmere (AU)

( * ) Notice: Subject to any disclaimer, the term of this patent is extended or adjusted under 35 U.S.C. 154(b) by 565 days.

(21) Appl. No.: 11/577,410

(22) PCT Filed: Oct. 20, 2005

(86) PCT No.: PCT/IB2005/004080

§ 371 (c)(1),
(2), (4) Date: Apr. 17, 2007

(87) PCT Pub. No.: WO2006/059238

PCT Pub. Date: Jun. 8, 2006

(65) Prior Publication Data

US 2008/0008585 A1 Jan. 10, 2008

(51) Int. Cl.
*F04B 35/04* (2006.01)

(52) U.S. Cl. ..... 417/423.11; 417/360; 277/427

(58) Field of Classification Search ..... 417/360, 417/423.11, 423.14; 277/427, 408; 415/168.2
See application file for complete search history.

(56) References Cited

U.S. PATENT DOCUMENTS

| | | | | |
|---|---|---|---|---|
| 2,375,085 | A * | 5/1945 | Curtis | 415/168.2 |
| 3,071,075 | A * | 1/1963 | Spring | 416/174 |
| 3,304,875 | A * | 2/1967 | Copeland | 417/423.14 |
| 4,375,291 | A | 3/1983 | Padgett | |
| 5,540,449 | A | 7/1996 | Algers et al. | |
| 5,660,521 | A | 8/1997 | Serio | |
| 6,287,074 | B1 | 9/2001 | Chancellor | |
| 6,695,576 | B2 * | 2/2004 | Rosso et al. | 415/113 |

* cited by examiner

*Primary Examiner*—Devon C Kramer
*Assistant Examiner*—Peter J Bertheaud
(74) *Attorney, Agent, or Firm*—Craig M. Stainbrook; Strainbrook & Strainbrook, LLP

(57) ABSTRACT

A centrifugal pumps secondary seal is disposed between the pump housing cover (130) in the seal chamber and includes a rotatable annular slinger (440) axially disposed on the pump motor shaft for slinging water away from the motor shaft and a flange protector (300) with a drain (400, 430) for diverting and directing free liquid from the seal chamber and outside the motor and pump housing (130, 230), thereby preventing corrosion of the seal chamber components, such as the motor flange (230), drive shaft and other motor components, due to exposure to water.

10 Claims, 3 Drawing Sheets

PUMP SECONDARY SEAL

BACKGROUND OF THE INVENTION

1. Technical Field

The present invention relates generally to water pumps, and more particularly to a secondary seal for a centrifugal pump.

2. Background Art

Next to electric motors, mechanical pumps are the most common machine in the world, and centrifugal pumps are perhaps the most widely employed type of pump inasmuch as they are well suited to pumping high volumes of water with a smooth flow. However, centrifugal pumps are notoriously prone to leaks due to mechanical seal failures in the seal chamber between the pump housing and the motor casing. Damage from leaks is not limited to the environment surrounding the pump; often damage extends to the pump itself, most notably including the motor flange, which can suffer rapid corrosion, particularly when a primary mechanical seal failure exposes the motor flange to salt water or chemicals used in the treatment of pool and spa water. Accordingly, it is desirable to have a means to drain fluid that might collect in the pump seal chamber and divert it from contact with the pump motor flange.

Several pump back-up seals have been devised. A few exemplary patents disclosing such solutions include: U.S. Pat. No. 4,375,291, to Padgett, which teaches a pump assembly having primary and back-up or secondary seals, the latter provided to prevent the escape of fluid being pumped from the pump housing upon failure of the primary seal assembly. The secondary seal includes a ring supported against rotation and surrounding the drive shaft or the shaft sleeve. The ring support is constructed of a material which will collapse under pressure of the pumped fluid if the primary seal fails, thereby sealing the space between the shaft and the housing or case to prevent fluid from escaping to the exterior of the housing.

U.S. Pat. No. 6,287,074, to Chancellor, shows a centrifugal pump having a bearing assembly with a rotating portion that rotates with the motor shaft, and a non-rotating portion that doesn't rotate with the shaft. The bearing assembly is disposed outside the fluid flow path. A non-rotating seal is axially slidable on the motor shaft, and a surface of the slidable seal is biased against a surface of the rotating portion of the bearing assembly to form a primary seal. A non-rotating secondary seal seals the non-rotating sealing member and is not in direct contact with the bearing assembly.

U.S. Pat. No. 5,540,449, to Algers et al., teaches a back-up pump seal for use with a centrifugal pump having a rotating shaft, and the seal assembly includes a movable primary seal rotatable with the shaft and a fixed secondary seal axially spaced along the shaft from the primary seal. It further includes an inlet for flushing liquid, an outlet for the flushing liquid and for pump medium that leaks through the primary seal, a collection chamber between the primary and secondary seals for flushing liquid and leaking pump medium, and a drain passage connecting the collection chamber and outlet. The collection chamber is divided into at least two portions in liquid communication with each other and with the drain passage to assure that the flushing liquid is maintained between the primary and secondary seals for an extended period of time for advantageously efficient use of the flushing liquid in lubrication and cooling of the primary seal.

U.S. Pat. No. 5,660,521, to Serio, shows an alternative solution to leakage due to pump primary seal failure. This patent discloses a water pump adapted for use in an internal combustion engine. The pump includes a leakage drain cavity disposed about the pump motor shaft in the pump housing and including a weep hole extending from the drain cavity outside the housing. A water pump seal is positioned between the pump impeller and the drain cavity and includes a central opening defining a leak path to the drain cavity. A coolant wick of absorbent material is disposed in the drain cavity forming an absorbent barrier in the leak path.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

DISCLOSURE OF INVENTION

The present invention is a secondary seal pump directed to preventing damage to seal chamber components on centrifugal water pumps. It is interposed between the pump housing cover and the motor flange or motor casing cover) in the seal chamber and provides a drain for diverting and directing free liquid from the chamber to the environment outside the motor and pump housing. In so doing, the inventive pump secondary seal protects the motor flange, drive shaft, and other critical motor components.

It is therefore an object of the present invention to provide a new and improved centrifugal pump secondary seal that protects pump motor components from corrosive fluids.

It is another object of the present invention to provide a new and improved pump secondary seal that diverts and directs water away from the pump and motor housing.

A further object or feature of the present invention is a new and improved pump secondary seal assembly that includes a slinger to propel water outwardly from the pump motor drive shaft.

An even further object of the present invention is to provide a novel pump secondary seal that includes a fluid discharge mechanism for channeling water away from motor components and outside the pump and pump motor housings.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and the objects of the invention will become apparent when consideration is given to the following detailed description thereof. Such description makes reference to the annexed drawings wherein.

BEST MODE FOR CARRYING OUT THE INVENTION

Figure 1:
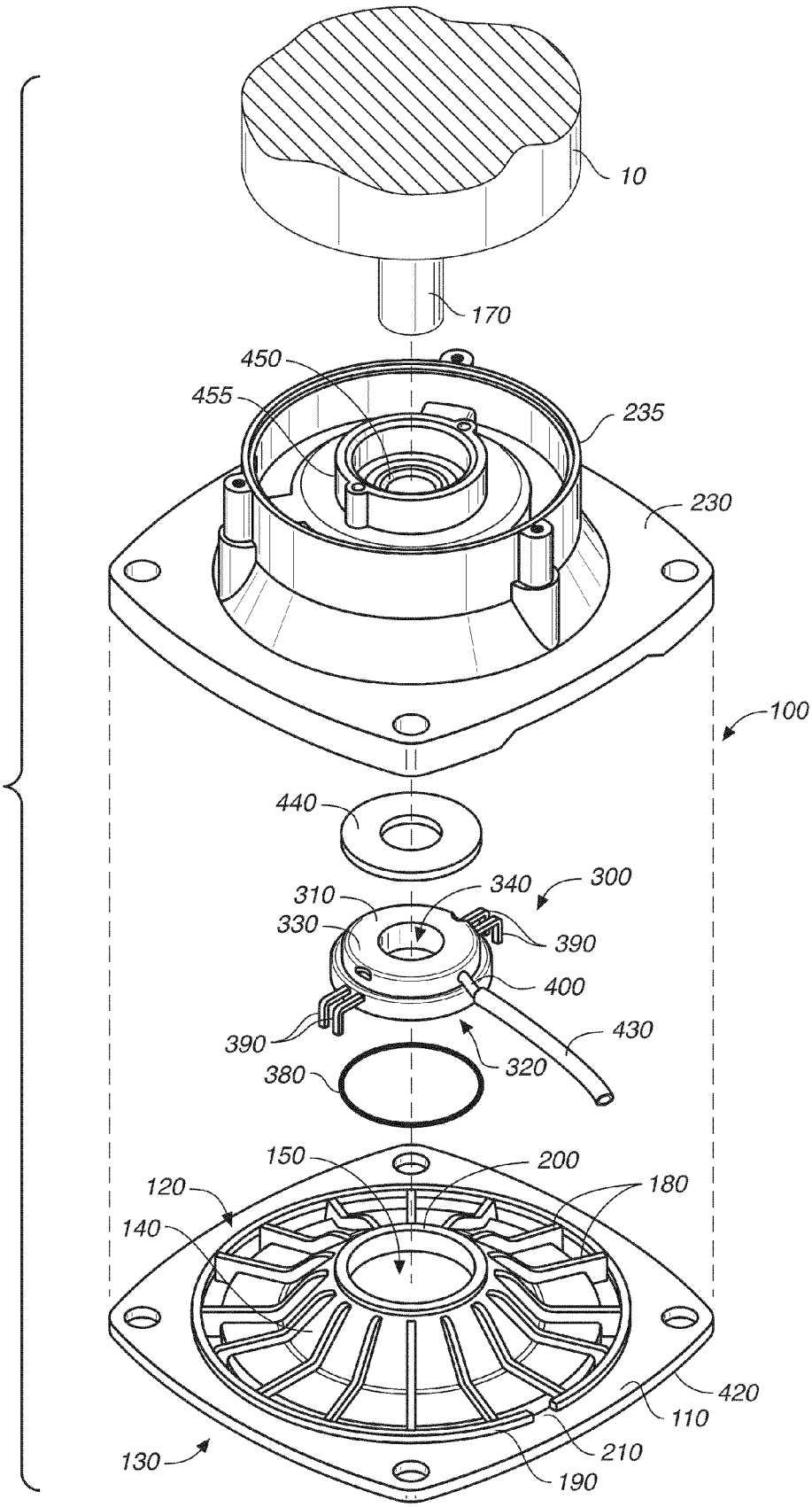
FIG. 1 is an exploded perspective view of the pump secondary seal of the present invention, along with the important environmental elements of an installation, including the pump motor and motor casing cover, but not including the pump impeller.
Figure 2:
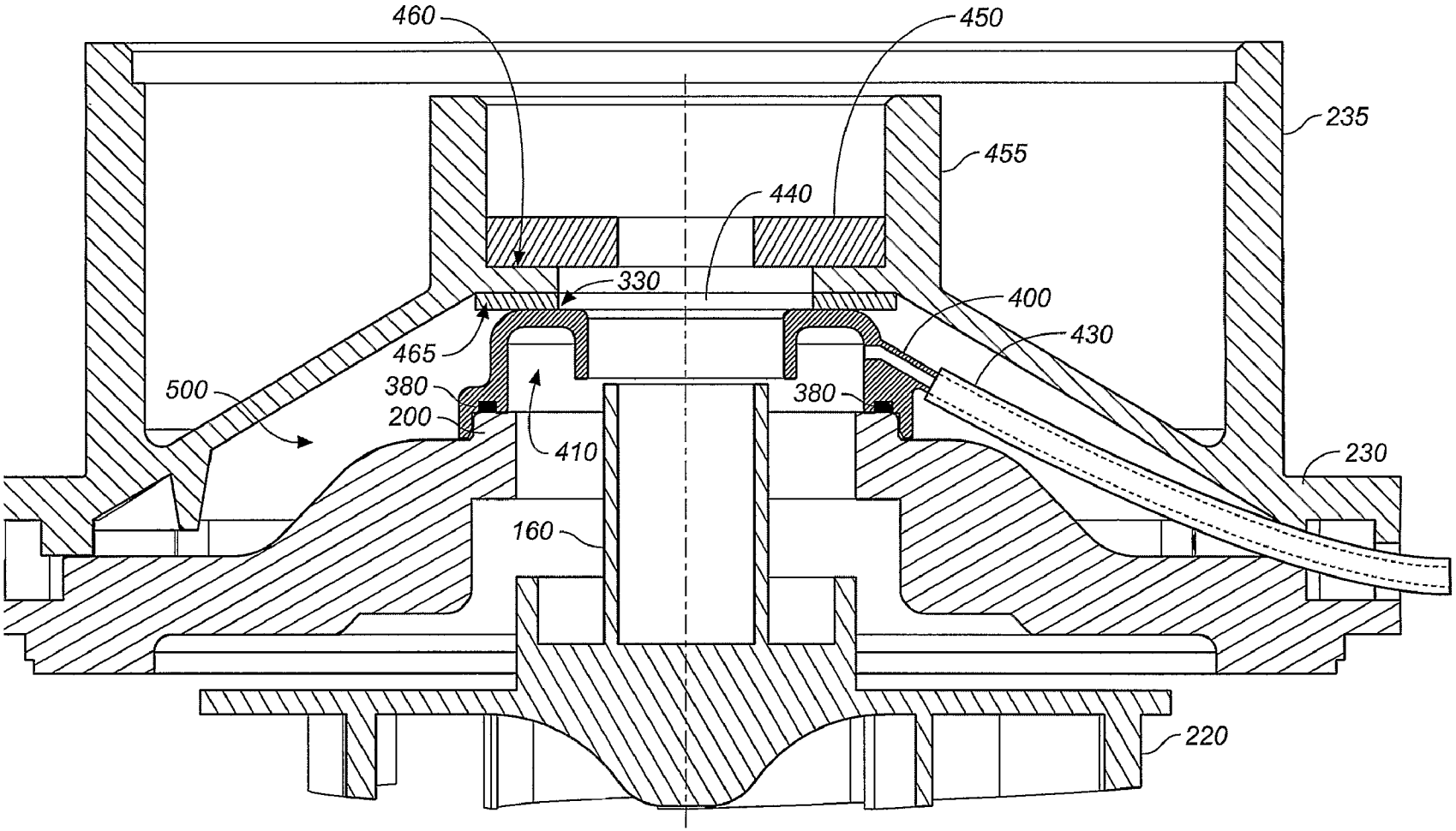
FIG. 2 is a cross-sectional side elevation view thereof.
Figure 3:
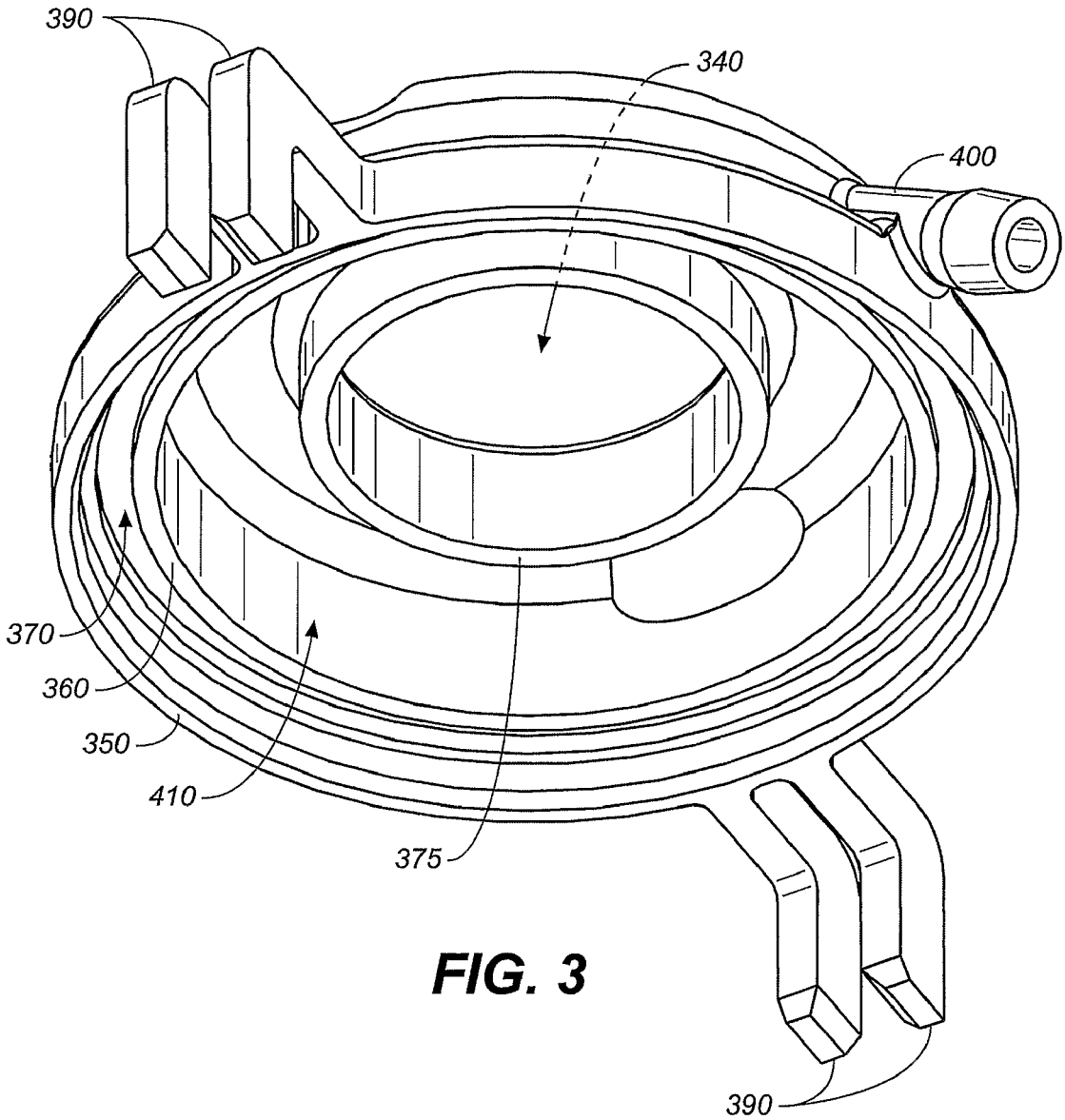
FIG. 3 is a lower perspective view of the flange protector and drain tube coupling.

Referring to FIGS. 1 through 3, wherein like reference numerals refer to like components in the various views, there is illustrated therein a new and improved pump secondary seal, generally denominated 100 herein, for use with a centrifugal pump having a pump motor 10, a motor drive shaft 170, and a pump housing (not shown) which houses an impeller 220 operatively connected to the motor drive shaft.

As a first element, the secondary seal comprises a water pump housing cover, or adapter plate, 110, having a seal chamber side 120, a pump housing side 130, and a substantially conical interior portion 140 with a center opening 150 through which an impeller shaft 160 and the motor drive shaft 170 are axially disposed. Preferably the conical interior includes a plurality of radially disposed reinforcement ribs 180 on the seal chamber side that terminate at their distal ends in an integral outer raised ring 190 and at their proximal ends proximate to and slightly outside of an inner raised ring 200. The outer raised ring includes a slot, cut, or channel 210 which accommodates a fluid discharge pipe, or drain pipe 400, and a flexible extension tube 430.

The pump housing cover is placed over the pump impeller 220 to enclose the pump housing cover and cover the impeller (refer here to FIG. 2 only, as the impeller is not shown in either of FIG. 1 or 3). It is also screwed or otherwise mounted on the motor casing cover (or motor flange) 230 so that the seal chamber side faces the motor flange and such that an interior space or seal chamber 500 is defined between the pump housing cover and the motor flange. The impeller shaft 160 is journalled in a bushing with tight tolerances and a primary seal that generally prevents leakage from the pump housing into the seal chamber 500 between the pump housing cover and the motor flange 230. The bushing and primary seal are structures well known in the art and are not shown.

Next, the secondary seal includes a flange protector 300, preferably comprising a substantially annular cup portion 310 having an underside 320 for engaging the pump housing cover, a top side 330, and a central opening 340 through which the motor drive shaft 170 and/or impeller shaft 160 is disposed. The underside 320 includes spaced-apart annular outer and inner rims 350, 360, the outer rim extending slightly lower than the inner rim, and the space between the rims defining a channel 370 sufficient to accommodate an O-ring 380. The annular cup further includes an annular interior collar 375 spaced apart from the inner rim 360 such that an interior space 410 is defined between the inner rim and the collar. The flange protector is disposed over the inner raised ring 200 such that the outer rim 350 rests atop the conical interior portion 140 of the pump housing cover 110 and the inner rim 360 rests atop the inner raised ring 200 and so that O-ring 380 is disposed between the flange protector and the inner raised ring 200 of the pump housing cover.

The flange protector further includes fingers 390 for engaging at least two of the ribs 180 of the pump housing cover 110 so as so secure the annular cup 310 and prevent it from rotation caused by the motor drive shaft 170.

The secondary seal also includes a drain pipe 400 in fluid communication with the open interior space 410 of annular cup 310. The pipe may extend a length sufficient to reach a point at the periphery 420 of the pump housing cover so that captured water is diverted out of the housing. Alternatively, and preferably, a flexible extension tube 430 is coupled to the drain pipe and disposed downwardly between the motor flange 230 and the pump housing cover 110 so that replacement is facilitated and the likelihood of damage is reduced, in which event the flexible tube extends to a point outside of the seal chamber 500 so that water contact with motor elements is minimized.

Preferably, at least two of the pump housing cover reinforcement ribs 180 include integral bosses disposed on their upper surfaces, each to accept a screw that passes through the secondary seal fingers 390 to hold the secondary seal in place. Additionally, the bosses provide spacing so that a rubber washer, or slinger, 440, may be axially disposed on the motor drive shaft 170 between the top side 330 of flange protector 300 and the central underside portion 465 of bearing housing 460. The slinger 440 is sized with an interior diameter that substantially matches the exterior diameter of the motor drive shaft so that it rotates with the shaft to propel water outwardly when water enters the seal chamber 500. Water so propelled will run down the conical interior portion 140 of pump housing cover 110 and drain from any opening provided at the outer edges of the pump housing cover 110 and the motor flange 230.

It will be appreciated from the foregoing that when there is a mechanical failure of the adapter plate seal, water will intrude into the seal chamber 500. However, the centrifugal pump secondary seal of the present invention intercepts the migration of most water with the captures such an intrusion and, in cooperation with the slinger, diverts it away from the seal chamber and into the outside environment. Accordingly, water will be prevented from coming into contact with the motor flange 230, the throat bearing 450, the bearing housing 460, the motor flange 230, and other expensive parts that are especially susceptible to corrosion and difficult to replace. Additionally, the secondary seal will provide a visual indication of the need to replace seal components before any parts suffer costly damage.

It will further be appreciated that in its most essential aspect, the inventive apparatus is an assembly for use with a centrifugal pump having a pump motor with a motor drive shaft, and a pump housing with an impeller having an impeller shaft operatively connected to the motor drive shaft, the assembly comprising a motor casing cover having a central hole through which the motor drive shaft is disposed, a pump housing cover for attachment to the pump housing to enclose and cover the impeller, the pump housing cover having a seal chamber side, a pump housing side, and a interior portion with a central opening through which the impeller shaft and the motor drive shaft are axially disposed, and attached to the motor casing cover so as to define a seal chamber space between the seal chamber side and the motor casing cover; and water channeling means for intercepting water that leaks from the pump housing before it enters the seal chamber and discharging it to the environment outside.

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

What is claimed as invention is:

1. A pump secondary seal assembly for use with a centrifugal pump having a pump motor with a motor drive shaft, and a pump housing with an impeller having an impeller shaft operatively connected to the motor drive shaft, said assembly comprising:

a motor casing cover having a central hole through which the motor drive shaft is disposed, a pump housing cover for attachment to the pump housing to enclose and cover the impeller, said pump housing cover having a seal chamber side, a pump housing side, and a interior portion with a central opening through which the impeller shaft and the motor drive shaft are axially disposed, said pump housing cover attached to said motor casing cover and interposed between said motor casing cover and the centrifugal pump so as to define a seal chamber space between said seal chamber side and said motor casing cover; and an annular flange protector disposed on said seal chamber side of said pump housing cover and having a substantially annular cup portion with an interior space and a central opening through which the pump motor drive shaft and/or impeller shaft are axially disposed for intercepting water that leaks from the pump housing before it enters the seal chamber and discharging it to the environment outside; and a fluid discharge tube in fluid communication with the interior space of said flange protector and extending to the environment outside the seal chamber;

wherein said pump housing cover includes a raised inner ring surrounding its central opening, and wherein said flange protector includes said substantially annular cup portion comprising an underside having an interior space, a top side, and a central opening through which the pump motor drive shaft and/or impeller shaft are disposed; wherein said underside includes spaced-apart annular outer and inner rims defining a channel; and wherein said outer rim rests atop said interior portion of said pump housing cover and said inner rim rests atop said inner raised ring.

2. The assembly of claim 1, wherein said pump housing cover includes a conical interior portion.

3. The assembly of claim 2, wherein said conical interior portion includes a plurality of radially disposed reinforcement ribs disposed on said seal chamber side, each of said ribs having a distal end terminating in an integral outer raised ring and a proximal end terminating proximate to and slightly outside of an inner raised ring surrounding the central opening of said pump housing cover.

4. The assembly of claim 3, wherein said outer raised ring includes a slot through which water channeling means is disposed.

5. The assembly of claim 1, further including a washer disposed between said water channeling means and said motor casing cover, and axially disposed around the motor drive shaft such that it rotates when the pump motor is in operation.

6. The assembly of claim 1, further including an 0-ring interposed between said flange protector and said raised inner ring and disposed in the channel defined by said inner and outer rims of said flange protector.

7. The assembly of claim 6, wherein said annular cup includes an annular interior collar spaced apart from said raised inner ring such that the interior space of said underside is defined between said raised inner ring and said collar.

8. The assembly of claim 1, wherein said seal chamber side of said pump housing cover includes a plurality of ribs, each extending radially from said raised inner ring to a raised outer ring.

9. The assembly of claim 8, wherein said flange protector further includes at least two sets of fingers for engaging at least two of said ribs so as so secure said flange protector and prevent it from rotating under the influence of the motor drive shaft.

10. The assembly of claim 1, further including a washer disposed between said annular flange protector and said motor casing cover, and axially disposed around the motor drive shaft such that it rotates when the pump motor is in operation.

* * * * *